United States Patent [19]

Kaufman et al.

[11] 4,419,255

[45] Dec. 6, 1983

[54] LUBRICATING OIL CONTAINING KETO AMIDE AS FRICTION REDUCING AGENT

[75] Inventors: Benjamin J. Kaufman; Robert A. Sawicki, both of Wappingers Falls; Stephen A. Levine, Fishkill, all of N.Y.

[73] Assignee: Texaco Inc., White Plains, N.Y.

[21] Appl. No.: 344,321

[22] Filed: Feb. 1, 1982

[51] Int. Cl.[3] ..... C10M 1/32

[52] U.S. Cl. ..... 252/51.5 A; 548/237; 548/352; 564/123; 564/138; 564/189

[58] Field of Search ..... 548/237, 352; 564/123, 564/138, 189; 252/51.5 A

[56] References Cited

U.S. PATENT DOCUMENTS

| | | | |
|---|---|---|---|
| 2,677,705 | 5/1954 | Utzinger | 564/123 |
| 3,200,075 | 8/1965 | Anderson | 252/51.5 A |
| 3,734,865 | 5/1973 | Heiba et al. | 252/51.5 A |
| 3,852,296 | 12/1974 | Viterbo et al. | 564/189 X |
| 3,897,350 | 7/1975 | Heiba et al. | 252/51.5 A X |
| 4,329,286 | 5/1982 | Heiba et al. | 252/51.5 A X |

*Primary Examiner*—Andrew Metz

*Attorney, Agent, or Firm*—Carl G. Ries; Robert A. Kulason; Carl G. Seutter

[57] ABSTRACT

Lubricating oil characterized by improved friction reduction contains friction reducing amounts of a keto amide prepared by the reaction of an amine and an unsaturated cyclic keto acid bearing pendant alkyl groups.

42 Claims, No Drawings

LUBRICATING OIL CONTAINING KETO AMIDE AS FRICTION REDUCING AGENT

FIELD OF THE INVENTION

This invention relates to a lubricating oil composition particularly characterized by decreased friction. More particularly, it relates to a friction modifier composition which permits attainment of lubricating oils characterized by decreased friction.

BACKGROUND OF THE INVENTION

As is well known to those skilled in the art, lubricating oil compositions permit operation of internal combustion engines at high efficiency. Lubricants of improved lubricity which permit operation with lesser friction make it possible to extend the efficiency and life of these engines, and the increased efficiency results in better fuel economy.

It is an object of this invention to provide a composition which may be added to a lubricating oil as an improved friction modifier. Other objects will be apparent to those skilled in the art.

STATEMENT OF THE INVENTION

In accordance with certain of its aspects, this invention is directed to a process which comprises treating a ($C_3$–$C_{20}$) alkenyl succinic acid anhydride at 69° C.–160° C. for 1–48 hours, in the presence of a strong Bronsted acid having a $pK_a$ of less than about −9, as catalyst thereby forming a cyclic keto acid;

reacting said cyclic keto acid with an amine selected from the group consisting of (i) $HO(CH_2CH_2NH)_xH$ wherein x is 1–10;
(ii) $H_2N(CH_2CH_2NH)_xH$ wherein x is 1–10;
(iii) $((H_2CZ)(CHZ)_x(CH_2Z)$ wherein x is 1–6, Z is OH or $NH_2$ and at least one Z is $—NH_2$;
(iv) $(HOCH_2CH_2)_xNH_{3-x}$ wherein x is 2;
(v) $H_2NCH_x(CH_2OH)_{3-x}$ wherein x is 0–1;
(vi) imidazolines; and
(vii) oxazolines thereby forming a keto amide; and
recovering said keto amide.

DESCRIPTION OF THE INVENTION

The charge compositions which may be used to prepare the friction modifier of this invention may include $C_3$–$C_{20}$ alken-2-yl-dicarboxylic anhydrides having the formula

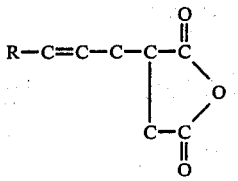

(I)

wherein R is hydrogen or a $C_1$–$C_{17}$ alkyl hydrocarbon.

In the above formula, the R group may be hydrogen, methyl, ethyl, n-propyl, i-propyl, n-butyl, t-butyl, sec-butyl, amyl, hexyl, octyl, decyl, etc. It will be apparent that the moiety bearing the R group may be designated a $C_3$–$C_{20}$ alken-2-yl group. Typical of such moieties may be penten-2-yl when R is the ethyl group.

Typical of the charge compositions is the substituted succinic anhydride:

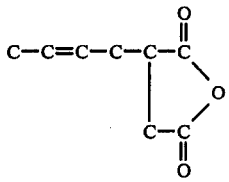

Anhydrides of substituted acids may be employed. The acid may bear inert substituents on any of the carbon atoms i.e. substituents which do not interfere with the course of the reaction.

The preferred charge compositions may be those derived from succinic anhydride and preferably wherein R is hydrogen or $C_1$–$C_5$ lower alkyl—typically methyl, ethyl, propyl, butyl, or amyl. Illustrative specific charge compositions may include:

propen-2-yl-succinic anhydride
buten-2-yl-succinic anhydride
penten-2-yl-succinic anhydride
hexen-2-yl-succinic anhydride
buten-2-yl-glutaric anhydride
penten-2-yl-adipic anhydride etc.

The charge compositions may be available or they may be prepared as by the reaction of anhydrides of unsaturated dicarboxylic acids with olefins having a double bond in the 1-position—typified by the reaction of maleic acid anhydride and 1-butene.

The charge $C_3$–$C_{20}$-alken-2-yl dicarboxylic acid anhydride is converted to a cyclic keto acid by contact, in inert solvent, with a strong Bronsted acid catalyst, typified by a superacid resin catalyst. The strong Bronsted acid catalysts which may be employed have a $pK_a$ of less than about −9 and typically −10 to −15.

The inert solvents which may be employed in practice of the process of this invention include non-aqueous media such as those which have heretofore been employed in Friedel-Craft reactions. These inert diluents typically include hydrocarbons including benzene, toluene, xylene, etc; liquid halogenated hydrocarbons typified by methylene dichloride, chloroform, carbon tetrachloride, trichlorethane, etc; and liquid nitrohydrocarbons typified by nitrobenzene, nitropropane, nitrobutane; carbon disulfide; etc.

Preferably the inert solvent is present in amount of 100–1000 parts, say 400 parts per 100 parts of charge composition.

The catalysts (including superacid resin catalysts) which may be employed in practice of the process of this invention may be characterized by their pKa of less than −9 and typically −10 to −15 as defined by N. L. Allinger et al in *Organic Chemistry* Worth Publishers Inc. (1971), p 265. Commercially available strong Bronsted acids, which are typical of those which may be employed, may include:

TABLE

| | |
|---|---|
| (i) | $HClO_4$ — perchloric acid |
| (ii) | $CF_3SO_3H$ — trifluoromethane sulfonic acid |
| (iii) | $FSO_3H$ — fluoro sulfonic acid |
| (iv) | Nafion H-501 resin-a perfluorosulfonic acid polymer superacid resin catalyst made by DuPont. |

Catalyst may be present in catalytic amount of 1–10 parts, say 5 parts per 100 parts of charge composition.

This catalytic amount of catalyst is found to permit reaction to be readily carried out.

The preferred strong Bronsted acid may be one contained in an organic resin or inorganic support. This allows for easy removal from the reaction mixture as by filtration and easy recycle or regeneration. One such preferred superacid resin catalyst is the Nafion H-501 catalyst, an anhydrous acidic resin stable at temperatures above 100° C. Other suitable catalysts include the well-known cross-linked styrene/divinylbenzene copolymers containing sulfonic acid groups which are preferably prepared so as to be highly porous. Such macroporous resins are well-known and may be produced, for example, according to the procedures of U.S. Pat. Nos. 3,418,262; 3,509,078; 3,551,358; 3,637,535 or 3,586,646. A preferred catalyst may be a perfluorosulfonic acid polymer in the acid form. An example of such a resin is Nafion 501, a granulated perfluorosulfonic acid polymer of 1.0 mm diameter nominal size. The resin is formed by copolymerization of tetrafluoroethylene and various monomers such as perfluoro-3.6-dioxa-4-methyl-7-octene sulfonyl fluoride. The resin is available commercially from E. I. duPont de Nemours and Company.

Prior to use the resin is treated with a strong acid so as to convert the resin into the acid form.

Catalyst may be present in catalytic amount of 1–10 parts, say 5 parts per 100 parts of charge composition. This catalytic amount of catalyst is found to permit reaction to be readily carried out.

Reaction may be carried out by contacting the charge anhydride in inert solvent in the presence of the catalytic amount of catalyst. Typically temperature is 25° C.–180° C., preferably 69° C.–145° C., say 98° C.; and pressure may be atmospheric pressure. Reaction normally may proceed with agitation over 1–48 hours, say 24 hours at the reflux temperature of the solvent, commonly heptane.

Work-up of the reaction mixture may include filtration to remove the preferred strong Bronsted acid resin catalyst (which may be readily reused repeatedly without any regeneration treatment). The solvent may then be stripped off if desired—although the reaction mixture may if desired be used as is i.e. product plus solvent. The product, usually crystalline, may be recrystallized from the same or different solvent.

The product keto acid reaction mix may prinicpally contain two keto acids. Reaction may be considered to include the following:

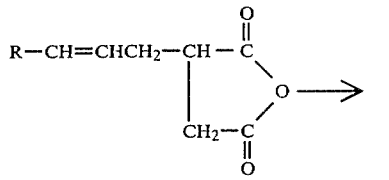

(I)

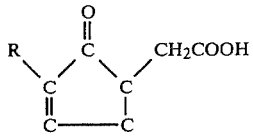

(II)

+

-continued

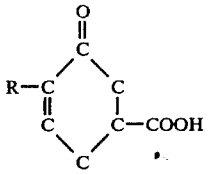

(III)

Although it may be possible to effect separation of the two product cyclic keto acids by chromatographic methods (gas or column chromatography) it is found that for many uses this is not necessary. If the product is to be converted to keto amides, satisfactory results may be attained with no further work-up or pretreating after preferred removal of the solvent.

Typical of the products is that containing 2-alkylcyclohexene-3-one-5-carboxylic acid (IV) and the corresponding five-member ring (V).

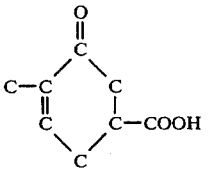

(IV)

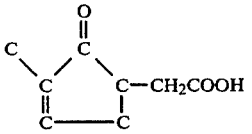

(V)

In practice of the process of this invention, the cyclized keto acid typically prepared as noted and without separation of the several cyclic products from each other may be amidated by reacting with an amine selected from the group consisting of (i) $HO(CH_2CH_2NH)_xH$ wherein x is 1–10;

(ii) $H_2N(CH_2CH_2NH)_xH$ wherein x is 1–10;

(iii) $(H_2CZ)\ (CHZ)_x\ (CH_2Z)$ wherein x is 1–6 and Z is —OH or $NH_2$ and at least one Z is $—NH_2$;

(iv) $(HOCH_2CH_2)x\ NH_{3-x}$ wherein x is 2;

(v) $H_2NCH_x\ (CH_2OH)_{3-x}$ wherein x is 0–1;

(vi) imidazolines; and (vii) oxazolines thereby forming a keto amide; and recovering said keto amide.

When the amine has the formula $HO(CH_2CH_2NH)_xH$ wherein x is 1–10, the amine may typically be one of the following:

TABLE

| |
|---|
| $HOCH_2CH_2NH_2$ |
| $HOCH_2CH_2NHCH_2CH_2NH_2$ |
| $HOCH_2CH_2NHCH_2CH_2NHCH_2CH_2CH_2NH_2$ |

When the amine has the formula $H_2N(CH_2CH_2NH)_xH$ wherein x is 1–10, the amine may typically be one of the following:

TABLE

| |
|---|
| $H_2NCH_2CH_2NH_2$ |
| $H_2NCH_2CH_2NHCH_2CH_2NH_2$ |
| $H_2NCH_2CH_2NHCH_2CH_2NHCH_2CH_2NH_2$ |

When the amine has the formula $(H_2CZ)\ (CHZ)_x\ (CH_2Z)$ wherein x is 1–6 and Z is —OH or $—NH_2$, the amine may typically be one of the following:

TABLE

| |
|---|
| $H_2C-CH-CH_2$ (OH, OH, $NH_2$) |
| $H_2C-CH-CH_2$ ($NH_2$, OH, $NH_2$) |
| $H_2C-CH-CH_2$ ($NH_2$, $NH_2$, $NH_2$) |

When the amine has the formula $(HOCH_2CH_2)_x NH_{3-x}$ wherein x is 2 the amine may typically be one of the following:

TABLE

| |
|---|
| $(HOCH_2CH_2)_2NH$ |

When the amine has the formula $H_2NCH_x(CH_2OH)_{3-x}$ wherein x is 0–1, the amine may typically have the formula:

TABLE

| |
|---|
| $H_2NCH(CH_2OH)_2$ |
| $H_2NC(CH_2OH)_3$ |

When the amine is an imidazoline, it may typically be 2-imidazoline.

When the amine is an oxazoline, it may typically be 4-oxazoline.

The preferred amine may be monoethanolamine.

Amidation of the keto acid with the amine may be carried out by adding the keto acid in solution in inert solvent to a reaction vessel. Typical inert solvents may include hydrocarbons having a boiling point above about 100° C. A preferred inert hydrocarbon solvent is 100E Pale Stock HF. The keto acid may be present in amount of 50–500 parts, say 200 parts per 100 parts by weight of solvent.

To the mixture of keto acids, there is added the amine over 1–12, preferably 2–5, say 2 hours as the reaction mixture is heated to 80° C.–200° C., preferably 100° C.–150° C., say 110° C. Preferably, the amine is added in amount equivalent to the acid. In the case of the preferred monoamines, this is one mole of amine per one mole of keto acid.

After the amine addition is completed, the reaction mixture is maintained at the elevated temperature for 2–10 hours, say 2 hours to remove the water formed by this reaction and it is thereafter cooled to room temperature.

Typical of the keto amides of this invention may be those formed from the following:

TABLE

| | Acid | Amine |
|---|---|---|
| A. | Cyclized tetradecenyl-succinic acid anhydride (one mole) | monoethanolamine (1 mole) |
| B. | Cyclized tetradecenyl-succinic acid anhydride (one mole) | ethylene diamine (1 mole) |
| C. | Cyclized buten-2-yl succinic acid anhydride (one mole) | monoethanolamine (1 mole) |
| D. | Cyclized buten-2-yl succinic acid anhydride (one mole) | monoethanolamine (1 mole) |

Products may include those having the following formula

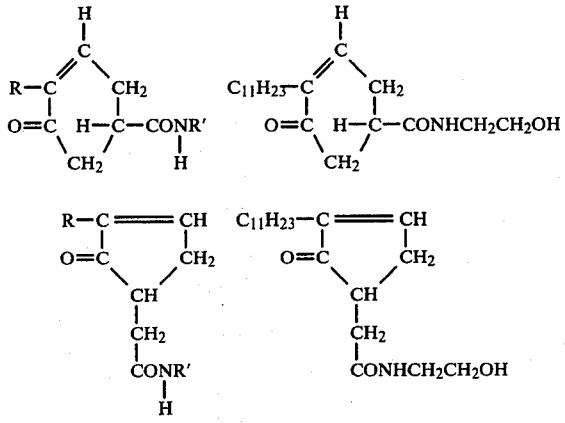

The lubricating oils which may be improved by the process of this invention may include hydrocarbon lubricating oils generally in use for internal combustion engines.

A preferred standard non-fuel-economy hydrocarbon motor oil maybe one containing additives including:

(i) 0.08–0.20% zinc from zinc dithiophosphate;

(ii) 0.05–1.0% methyl methacrylate pour depressant;

(iii) 0.05–0.50% of an ashless antioxidant;

(iv) 0.01–0.50% of polyethoxylated alkylphenol;

(v) 0.01–0.20% nitrogen from nitrogen-containing dispersant such as a polyalkenyl succinimide or a polyalkenylpolyamine;

(vi) 0.05–0.35% calcium from calcium sulfonate, calcium phenolate, sulfurized calcium phenolate (or combinations thereof);

(vii) 5–15% of ethylene-propylene copolymer or methacrylate ester polymer as viscosity index improver.

It is preferred to add 0.01–10 W % preferably 0.5–5 w %, say 1 w % of the friction improver of this invention to the hydrocarbon lubricating oil with agitation. The frictional improvement imparted by these additives results in enhanced fuel economy.

This may be observed by testing the lubricating oil compositions containing the additives in The Small Engine Friction Test.

The Four Ball Wear Test is carried out by securely clamping three highly polished steel balls (each 0.5 inch in diameter) in a test cup in an equilateral triangle in a horizontal plane. The fourth highly polished steel ball, resting in the three lower balls to form a tetrahedron is held in a chuck. A weight lever arm system applies weight to the test cup, and this load holds the balls together. In the standard test, the speed of rotation is 1800 rpm; the load is 5 kilograms. The assembly is submerged in the liquid to be tested. The standard test is carried out at ambient temperature for 30 minutes. As the chuck and upper ball rotate against the fixed lower balls, the friction of the upper ball rotating in relation to the lower balls produces a wear-scar the diameter of which (i.e. the depth along a diameter of the ball) is measured. The average of the wear on the three lower balls is the rating assigned (in millimeters).

BENCH VC TEST

In the Bench VC Test, a mixture containing the test oil and a diluent are heated at an elevated temperature. After heating, the turbidity of the resultant mixture is measured. A low % turbidity (0–10) is indicative of good dispersancy while high results (20–100) are indicative of oils of increasingly poor dispersancy.

SMALL ENGINE FRICTION TEST

The Small Engine Friction Test (SEFT) uses a single cylinder, air-cooled, 6-horsepower engine driven by an electric motor. The engine has a cast-iron block and is fitted with an aluminum piston and chrome-plated rings. The electric motor is cradled-mounted so that the reaction torque can be measured by a strain arm. The engine is housed in a thermally insulated enclosure with an electric heater and is driven at 200 rpm.

Prior to each test, the engine is flushed three times with 1-quart charges of test oil. During the test run, the engine and oil temperatures are increased continually from ambient until a 280° F. oil temperature is reached. The heat comes from engine friction, air compression work and from the electric heater. The engine and oil temperatures and the engine motoring torque are recorded continually during the test. A SEFT run takes about 4 hours. Each test oil evaluation is preceded by a run on a reference oil for a like period of time. The torque reference level for the engine shifts very slowly with time as a result of engine wear. Therefore, the test oil results were recorded compared to a reference band consisting of data from up to three reference runs made before and three runs made after the test oil evaluation.

The results are recorded in foot-pounds of torque at several temperatures. The results at 280° F. correlate most closely with field experience.

Use of the additive of this invention permits attainment of generally improved results as determined by these tests.

DESCRIPTION OF PREFERRED EMBODIMENT

Practice of this invention will be apparent to those skilled in the art from the following wherein, as elsewhere in this specification, all parts are parts by weight unless otherwise specified.

EXAMPLE I

In this example which represents the best mode known to me of practicing the process of this invention, there is charged to a 500 ml round bottom flask equipped with an overhead stirrer, nitrogen inlet tube, and condenser 100 g of tetradecenylsuccinic anhydride, 23 g of activated Nafion 501 acid resin and 200 ml of heptane. The mixture was refluxed for 24 hrs., cooled and filtered to remove the resin. The solvent was then removed by vacuum distillation yielding 79.5 g of a dark brown liquid.

To a 250 ml flask (equipped with an overhead stirred, nitrogen inlet tube and Dean-Stark trap with condenser) is charged 60 g of the above product and 69 g of 100 E Pale Stock HF. Monoethanolamine (13 g) is added dropwise and the mixture heated at 110° C. for 2 hrs. After cooling the mixture to room temperature, the mixture is filtered, yielding 108 g of product as a reddish-brown filtrate.

EXAMPLE II

A lubricating oil formulation is made-up by adding 1 w % of the product of Example I to the preferred standard non-fuel economy hydrocarbon motor lubricating oil. The formulation was subjected to the 4 Ball Wear Test, the Bench Dispersancy Test, and the Small Engine Friction Test.

EXAMPLE III*

A reference series was run on a comparable hydrocarbon lubricating oil composition which did not contain the additive of this invention, but contained a commercially used fuel economy additive.

EXAMPLE IV*

A second reference series was run on another comparable hydrocarbon lubricating oil composition which did not contain the additive of this invention or any fuel economy additive.

The results were as follows:

TABLE

| TEST | EXAMPLE IV* | EXAMPLE III* | EXAMPLE II |
|---|---|---|---|
| Four Ball Wear Test (mm) | 0.43 | 0.38 | 0.39 |
| Bench Dispersancy Test | 7.0 | 10.5 | 11.5 |
| Small Engine Friction Test (ft # torque at 280° F.) | — | 2.52 | 2.50 |
| Decrease in torque relative to a comparable hydrocarbon lubricating oil composition containing no fuel economy additive (%) | — | 6.1 | 6.9 |

Results comparable to those of Example I may be attained if there is added to the base oil, the keto acid of Example I which has been amidated by the following amines:

| EXAMPLE | ADDITIVE |
|---|---|
| IV | ethylene diamine |
| V | diethanolamine |
| VI | imidazoline |
| VII | oxazoline |

Although this invention has been illustrated by reference to specific embodiments, it will be apparent to those skilled in the art that various changes and modifications may be made which clearly fall within the scope of this invention.

We claim:

1. The process which comprises:

treating a ($C_3$–$C_{20}$) alkenyl succinic acid anhydride at 25° C.–180° C. for 1–48 hours, in the presence of a strong Bronsted acid having a pKa of less than about −9, as catalyst, thereby forming a cyclic keto acid;

amidating said cyclic keto acid with an amine selected from the group consisting of (i) $HO(CH_2CH_2NH)_xH$ wherein x is 1–10;

(ii) $H_2N(CH_2CH_2NH)_xH$ wherein x is 1–10;

(iii) $(H_2CZ)(CHZ)_x(CH_2Z)$ wherein x is 0–6, Z is —OH or $NH_2$, and at least one Z is $—NH_2$;

(iv) $(HOCH_2CH_2)_x NH_{3-x}$ wherein x is 2;

(v) $H_2NCH_x(CH_2OH)_{3-x}$ wherein x is 0–1;

(vi) imidazolines; and (vii) oxazolines thereby forming a keto amide; and
recovering said keto amide.

2. The process claimed in claim 1 wherein said amine is:

$$HO(CH_2CH_2NH)_xH$$

wherein x is 1–10.

3. The process claimed in claim 1 wherein said amine is $HOCH_2CH_2NH_2$.

4. The process claimed in claim 1 wherein said amine is $H_2N(CH_2CH_2NH)_xH$ wherein x is 1–10.

5. The process claimed in claim 1 wherein said amine is $H_2NCH_2CH_2NH_2$.

6. The process as claimed in claim 1 wherein said amine is $(H_2CZ)\ (CHZ)_xCH_2Z$ wherein x is 0–6 and Z is —OH or —$NH_2$.

7. The process claimed in claim 1 wherein said amine is $$HOCH_2\underset{\underset{NH_2}{|}}{C}HCH_2OH.$$

8. The process claimed in claim 1 wherein said amine is $$H_2NCH_2\underset{\underset{NH_2}{|}}{C}HCH_2NH_2.$$

9. The process claimed in claim 1 wherein said amine is $(HOCH_2CH_2)_xNH_{3-x}$ wherein x is 2.

10. The process claimed in claim 1 wherein said amine is $(HOCH_2CH_2)_2\ NH$.

11. The process claimed in claim 1 wherein said amine is $H_2NCH_x(CH_2OH)_{3-x}$ wherein x is 0–1.

12. The process claimed in claim 1 wherein said amine is $H_2N\ C\ (CH_2OH)_3$.

13. The process claimed in claim 1 wherein said amine is $H_2N\ CH\ (CH_2OH)_2$.

14. The process claimed in claim 1 wherein said amine is an imidazoline.

15. The process claimed in claim 1 wherein said amine is an oxazaline.

16. The process claimed in claim 1 wherein said treating is carried out in inert hydrocarbon solvent.

17. The process claimed in claim 1 wherein said amidating is carried out in inert hydrocarbon solvent.

18. The process claimed in claim 1 wherein said treating and said amidating are carried out in the same inert hydrocarbon solvent.

19. The process which comprises
treating tetradecenyl succinic acid anhydride in inert hydrocarbon solvent at reflux in the presence of superacid resin catalyst thereby forming a cyclic keto acid;
amidating said cyclic keto acid in inert hydrocarbon solvent at 69° C.–160° C. with monoethanolamine thereby forming a cyclic keto amide; and
recovering said cyclic keto amide.

20. A cyclic keto amide prepared by the process which comprises:
treating a ($C_3$–$C_{20}$) alkenyl succinic acid anhydride at 69° C.–160° C. in for 1–48 hours, in the presence of superacid resin catalyst thereby forming a cyclic keto acid;
amidating said cyclic keto acid with an amine selected from the group consisting of:
(i) $HO(CH_2CH_2NH)_xH$ wherein x is 1–10;
(ii) $H_2N(CH_2CH_2NH)_xH$ wherein x is 1–10;
(iii) $(H_2CZ)\ (CHZ)_x(CH_2Z)$ wherein x is 0–6, Z is —OH or —$NH_2$, and at least one Z is —$NH_2$;
(iv) $(HOCH_2CH_2)_x\ NH_{3-x}$ wherein x is 2;
(v) $H_2NCH_x\ (CH_2OH)_{3-x}$ wherein x is 0–1;
(vi) imidazolines; and
(vii) oxazolines
thereby forming a keto amide; and
recovering said keto amide.

21. A cyclic keto amide as claimed in claim 20 wherein said amine is:

$$HO(CH_2CH_2NH)_xH$$

wherein x is 1–10.

22. A cyclic keto amide as claimed in claim 20 wherein said amine is $H_2N(CH_2CH_2NH)_xH$ wherein x is 1–10.

23. A cyclic keto amide as claimed in claim 20 wherein said amine is $H_2NCH_2CH_2NH_2$.

24. A cyclic keto amide as claimed in claim 20 wherein said amine is $(H_2CZ)\ (CHZ)_xCH_2Z$ wherein x is 0–6 and Z is —OH or —$NH_2$.

25. A cyclic keto amide as claimed in claim 20 wherein said amine is $$H_2NCH_2\underset{\underset{NH_2}{|}}{C}HCH_2NH_2$$

26. A cyclic keto amide as claimed in claim 20 wherein said amine is $(HOCH_2CH_2)_xNH_{3-x}$ wherein x is 2–3.

27. A cyclic keto amide as claimed in claim 20 wherein said amine is $(HOCH_2CH_2)_2NH$.

28. A cyclic keto amide as claimed in claim 20 wherein said $H_2NCH_x(CH_2OH)_{3-x}$ wherein x is 0–1.

29. A cyclic keto amide as claimed in claim 20 wherein said amine is $H_2N\ C\ (CH_2OH)_3$.

30. A cyclic keto amide as claimed in claim 20 wherein said amine is $H_2NCH(CH_2OH)_2$.

31. A cyclic keto amide as claimed in claim 20 wherein said amine is an imidazoline.

32. A cyclic keto amide as claimed in claim 20 wherein said amine is an oxazoline.

33. A cyclic keto amide prepared by the process which comprises:
treating tetradecenyl succinic acid anhydride in inert hydrocarbon solvent at reflux in the presence of superacid resin catalyst thereby forming a cyclic keto acid;
amidating said cyclic keto acid in inert hydrocarbon solvent at 69° C.–160° C. with monethanolamine thereby forming a cyclic keto amide; and
recovering said cyclic keto amide.

34. A cyclic keto amide comprising:

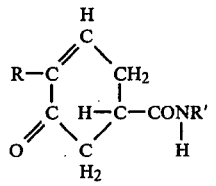

wherein R is hydrogen or $C_1$–$C_{17}$ alkyl, and

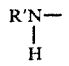

is an amine moiety.

35. A cyclic keto amide comprising:

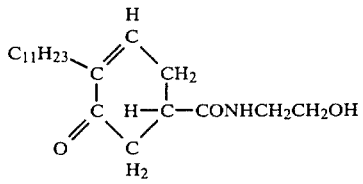

36. A keto amide comprising:

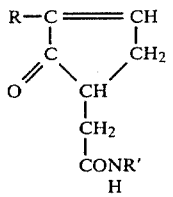

wherein R is hydrogen or $C_1$–$C_{17}$ alkyl, and

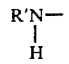

is an amine moiety.

37. A keto amide comprising:

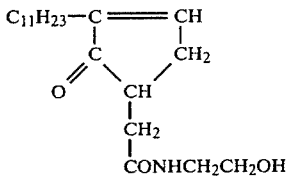

38. A lubricating oil composition which comprises:

(a) a major portion of a lubricating oil; and (b) a minor friction-improving amount of a cyclic keto amide prepared by the process which comprises:

treating a ($C_3C_{20}$) alkenyl succinic acid anhydride at 69° C.–160° C. in for 1–48 hours, in the presence of superacid resin catalyst thereby forming a cyclic keto acid;

amidating said cyclic keto acid with an amine selected from the group consisting of:

(i) $HO(CH_2CH_2NH)_xH$ wherein x is 1–10;

(ii) $H_2N(CH_2CH_2NH)_xH$ wherein x is 1–10;

(iii) $(H_2CZ)(CHZ)_x(CH_2Z)$ wherein x is 0–6, Z is —OH or $—NH_2$, and at least one Z is $—NH_2$;

(iv) $(HOCH_2CH_2)_xNH_{3-x}$ wherein x is 2;

(v) $H_2NCH_x(CH_2OH)_{3-x}$ wherein x is 0–1

(vi) imidazolines; and (vii) oxazolines thereby forming a keto amide; and recovering said keto amide.

39. A lubricating oil composition as claimed in claim 38 wherein said amine is monoethanolamine.

40. A lubricating oil composition as claimed in claim 38 wherein amine is present in friction improving amount of 0.5 w %–5 w % of said lubricating oil composition.

41. A lubricating oil composition which comprises:

(a) a major portion of a hydrocarbon lubricating oil; and (b) a minor, friction-improving amount, of 0.5 w %–5 w % of said lubricating oil, of a cyclic keto amide prepared by the process which comprises treating tetradecenyl succinic acid anhydride in inert hydrocarbon solvent at reflux in the presence of superacid resin catalyst thereby forming a cyclic keto acid;

amidating said cyclic keto acid in inert hydrocarbon solvent at 69° C.–160° C. with monoethanolamine thereby forming a cyclic keto amide; and recovering said cyclic keto amide.

42. The process for improving the friction characteristics of a lubricating oil which comprises:

adding to a major portion of a lubricating oil a minor friction-improving amount of a cyclic keto amide acid prepared by the process which comprises:

treating a ($C_3$–$C_{20}$) alkenyl succinic acid anhydride at 69° C.–160° C. in for 1–48 hours, in the presence of superacid resin catalyst thereby forming a cyclic keto acid;

amidating said cyclic keto acid with an amine selected from the group consisting of:

(i) $HO(CH_2CH_2NH)_xH$ wherein x is 1–10;

(ii) $H_2N(CH_2CH_2NH)_xH$ wherein x is 1–10;

(iii) $(H_2CZ)(CHZ)_x(CH_2Z)$ wherein x is 0–6, Z is —OH or $NH_2$, and at least one Z is $—NH_2$;

(iv) $(HOCH_2CH_2)_x NH_{3-x}$ wherein x is 2;

(v) $H_2NCH_x(CH_2OH)_{3-x}$ wherein x is 0–1;

(vi) imidazolines; and (vii) oxazolines thereby forming a keto amide; and recovering said keto amide.

* * * * *